United States Patent [19]

Arthur, Jr. et al.

[11] Patent Number: 5,060,428

[45] Date of Patent: Oct. 29, 1991

[54] PREFABRICATED WALLS

[75] Inventors: Reuben B. Arthur, Jr., Greensboro; James L. Edwards, Jamestown; Ernest H. Jeffries, Jr., Greensboro; Chester O. Westmoreland, Jr., Winston-Salem; Jerry W. Whitley, Greensboro, all of N.C.

[73] Assignee: Resco Products, Inc., Conshohocken, Pa.

[21] Appl. No.: 477,797

[22] Filed: Feb. 9, 1990

[51] Int. Cl.[5] ..... E02D 35/00

[52] U.S. Cl. ..... 52/125.6; 52/745; 52/561

[58] Field of Search ..... 52/745, 747, 125.2, 52/125.3, 125.6, 561, 562, 79.9, 79.12

[56] References Cited

U.S. PATENT DOCUMENTS 360,332 3/1887 Twiname ..... 52/747
430,810 6/1890 Pride ..... 52/562 X
2,969,884 1/1961 Salmi ..... 52/125.3 X
3,800,493 4/1974 Livingston ..... 52/125.6 X

*Primary Examiner*—David A. Scherbel
*Assistant Examiner*—L. Watson
*Attorney, Agent, or Firm*—Seidel, Gonda, Lavorgna & Monaco

[57] ABSTRACT

A prefabricated structure and method for constructing and lifting the same is provided wherein the structure comprises: (a) a wall unit having a plurality of horizontal courses of construction material stacked one atop another and arranged such that they define at least one generally vertical passage therein which opens through the unit's bottom end; (b) lifting means, positioned on the unit's upper end, for lifting and transporting the unit; (c) generally vertically-oriented banding means, which is in contact with the passes under at least a portion of the unit's bottom end, for securing the lifting means to the unit; and (d) spacer means fitted within the opening defined in the unit's bottom end.

41 Claims, 3 Drawing Sheets

FIG. 1
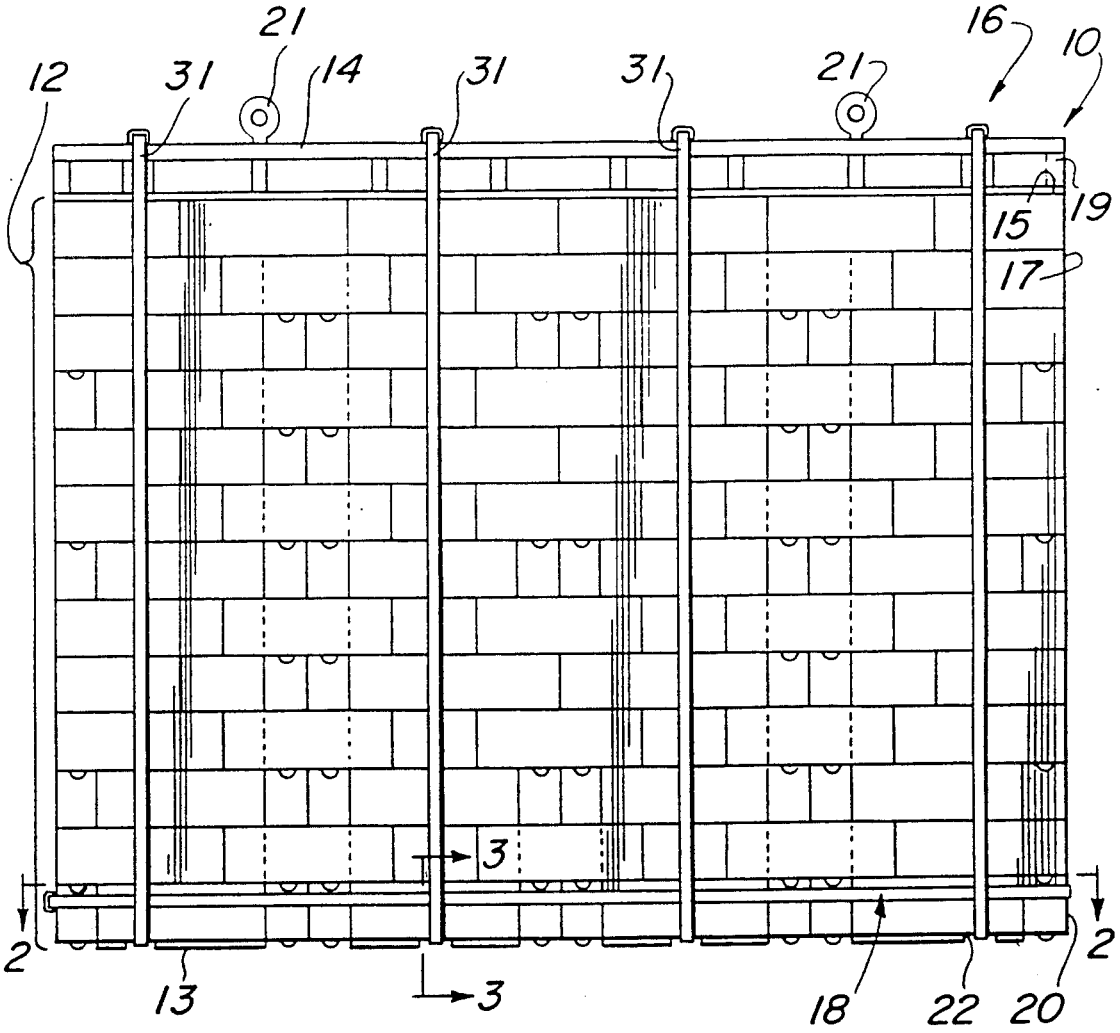
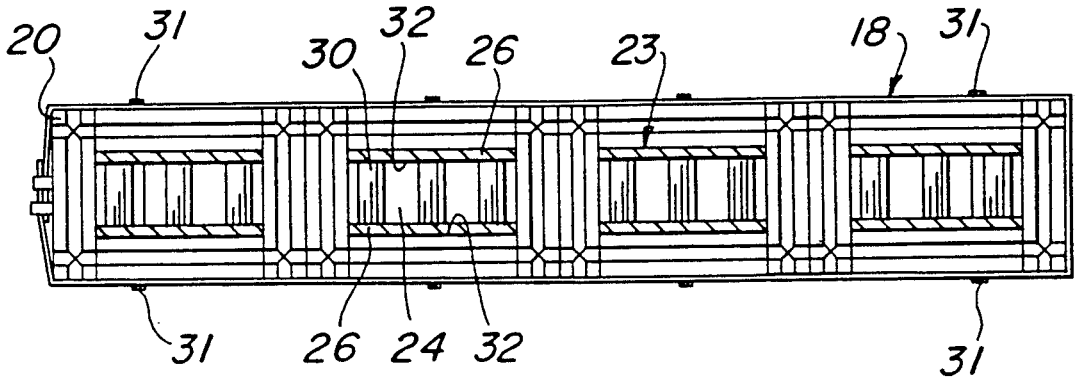
FIG. 2

FIG. 3
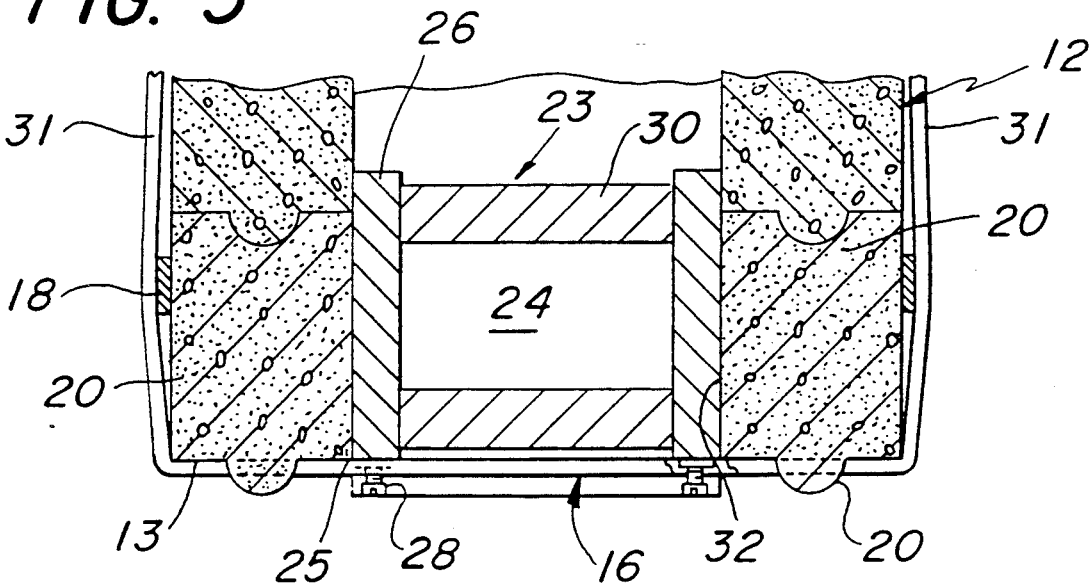
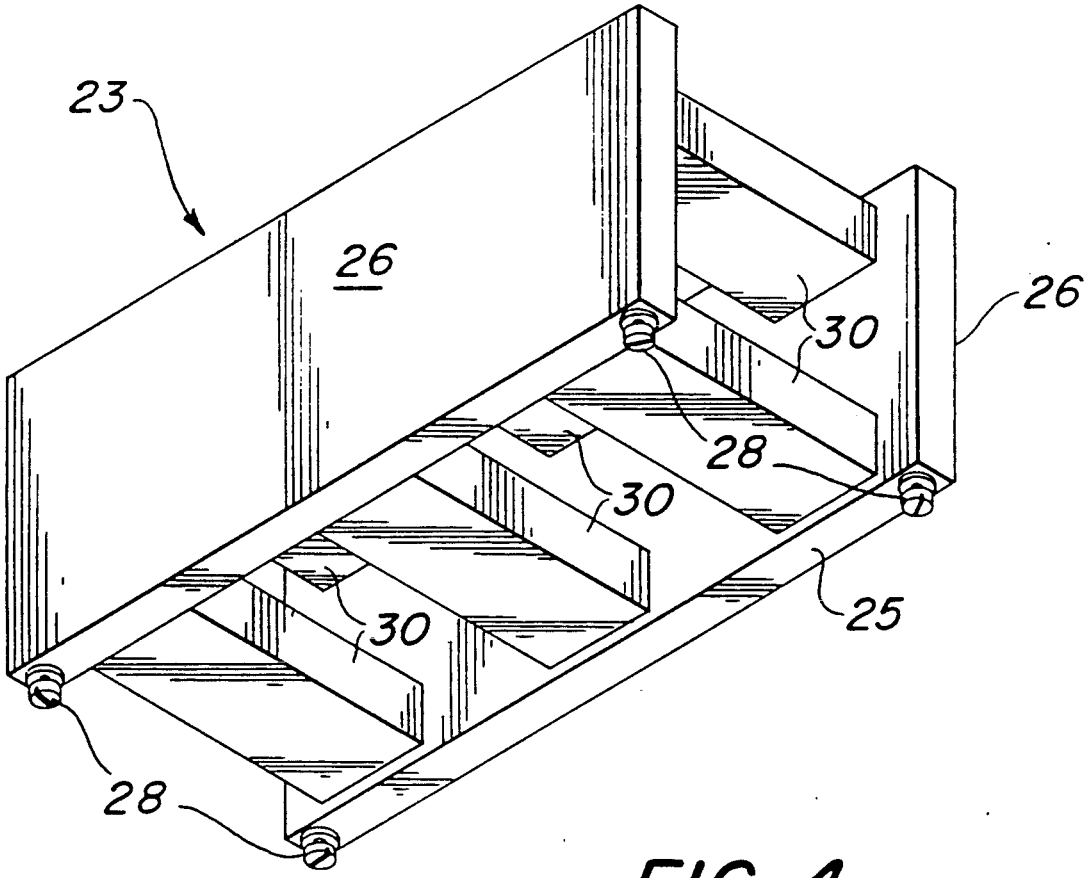
FIG. 4

PREFABRICATED WALLS

FIELD OF THE INVENTION

The invention pertains to the manufacture, lifting, transportation and/or utilization of prefabricated structures having generally vertical passages therein. More particularly, the prefabricated structures of the invention comprise a wall unit having a plurality of horizontal rows of construction material stacked one atop another and arranged to define passages therein which open through the units' bottom end.

BACKGROUND OF THE INVENTION

Wall units, having generally vertical passages therein defined by a plurality of horizontal rows of construction material stacked one atop another, are known. While these types of units can be employed in many different applications, they are especially useful when employed as integral components to heat transfer devices.

When used as parts of heat transfer devices, the wall units are often designed such that the passages defined therein open through at least the unit's bottom and/or top end.

One, but by no means the only, example of a heat transfer device wherein these types of wall units can be employed is a furnace, in which at least two independent wall units are generally spaced apart from one another to define a chamber therebetween. It is within this chamber that an item to be heated will be placed. Heated fluids and/or vapors are then channeled through the passages within each of the wall units. This increases the temperature within the chamber.

Industry has employed such wall units as a heat exchanger in many different ways. The overall heights of wall units employed in industry are dependent, in part, on their desired function, and can range from about three feet up to and exceeding forty feet.

One, but by no means the only, way in which such wall units are used, is in heating chambers for carbon baking furnaces. When constructing industrial-sized heat exchangers, it is often desirable, and/or more efficient, to prefabricate the wall units at a prefabrication site and then transport the prefabricated wall to a storage facility or directly to the installation site.

While wall units without openings through their bottom ends have been successfully prefabricated, problems result when prefabricating units which have openings passing through their bottoms. For example, one problem results when such a prefabricated wall unit is lifted using conventional lifting techniques.

A conventional technique of lifting and transporting wall units without openings through their bottom ends generally consists of placing a lifting means (e.g., a pallet) on top of the completed wall. Thereafter, generally vertical banding means are fitted around the periphery of the wall and over at least a portion of the lifting means to secure the lifting means to the completed unit.

The banding process employed in conventional lifting techniques generally consists of passing a vertically-oriented banding means under at least a portion of the wall unit's lowest course of construction material and over at least a portion of the lifting means. This conventional lifting process does not need a base pallet below the lowest course of construction material.

After the lifting means is securely attached to the prefabricated wall unit with the banding means, the structure is lifted by exerting an upward force on the lifting means. Since there is no base pallet employed with this conventional lifting technique, the structure can be lowered directly onto its installation site.

This conventional lifting technique cannot, however, be employed on prefabricated wall units wherein the passages therein open through the units' bottom end. If conventional lifting techniques are attempted, the sides of the wall will collapse into the passage, because when an upward force is exerted on the lifting means, the banding means exerts an inward force on the wall's lowest course of construction material. Since this course has the wall units' passages opening therethrough, the lowest course will collapse into these passages and all the remaining courses will follow.

Because of these problems, while it would be desirable to prefabricate industrial-sized wall units having generally vertical passages therein which open through the units' bottom, such walls are generally constructed on the installation site.

Moreover, even though it is known to prefabricate, lift and transport industrial-sized wall units wherein the passages therein do not pass through their bottom ends, problems can still arise in their prefabrication. While the prefabrication of such solid-bottomed wall unit's can be employed when constructing walls which are less than about ten feet tall, significant problems occur when constructing prefabricated walls which exceed this height. Specifically, when attempting to transport a prefabricated wall which is taller than about ten feet, problems result due to the relative clearance heights associated with overhead telephone and electric lines, bridges, tunnels and/or door openings.

While it may seem that this problem can be resolved by prefabricating the wall unit in a number of shorter sections, careful analysis indicates that this is not a solution. For example, if the prefabrication of a fourteen foot wall unit, having a passage therein which does not pass through the wall's bottom end, consists of prefabricating a lower and an upper section, the lower section can be successfully prefabricated, lifted, and transported using the aforementioned conventional lifting technique.

However, when prefabricating the upper section, the same problems will be encountered as those which result when employing the conventional lifting technique to lift an opened-bottomed wall unit. Specifically, while the wall may have a solid bottom, if the wall is bisected into two sections, the passage therein will also necessarily be bisected. Therefore, sectioning the wall will result in the upper section having an opening through its bottom end. As stated earlier, there is no known method for lifting such a prefabricated wall section without having it collapse in on itself.

SUMMARY OF THE INVENTION

One object of the invention is to provide a prefabricated structure which comprises a wall unit having passages defined therein, wherein the prefabricated unit can be lifted without significantly sagging and/or collapsing.

Another object of the invention is to provide a method of constructing and lifting a prefabricated wall unit comprising a plurality of horizontal rows of construction material defining passages therein which pass through the unit's bottom.

Yet another object of the invention is to provide a method for prefabricating a wall unit constructed of a plurality of horizontal rows of construction material defining a passage therein, wherein the wall has an overall height which exceeds about ten feet.

In one embodiment, the invention provides a prefabricated structure and a method for constructing and/or lifting the same, wherein the prefabricated structure comprises: (a) a wall unit having a plurality of horizontal courses of construction material stacked one atop another and arranged to define at least one generally vertical passage therein which opens through the unit's bottom end; (b) lifting means positioned on the unit's upper end for lifting the unit; (c) generally vertically-oriented banding means, which contacts and passes under at least a portion of the unit's bottom end, for securing the lifting means to the wall unit; and (d) spacer means fitted within the opening defined in the unit's bottom end.

In another embodiment, the invention provides a method for sectionally prefabricating a wall unit, wherein each individual section of the wall comprises a plurality of horizontal courses of construction material are stacked one atop another and arranged to define at least one generally vertical passage within the wall.

The present invention solves the aforementioned problems by providing a structure and prefabrication method which allows a wall unit, having openings in its bottom end, to be fabricated off-site. The novel structure provided by this invention can be lifted and transported without significant danger of collapse.

Other objects and advantages of this invention will become more readily apparent to those skilled in the art upon considering the following detailed description taken in conjunction with the accompanying drawings and appended claims.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a front elevational view of one embodiment of a prefabricated structure comprising a wall unit having passages defined therein which open through the unit's bottom.

FIG. 2 is a sectional view through line 2—2 of FIG. 1.

FIG. 3 is a sectional view through line 3—3 of FIG. 1.

FIG. 4 is a three-dimensional view of one embodiment of a spacer means.

DETAILED DESCRIPTION OF THE INVENTION

Figure 5:
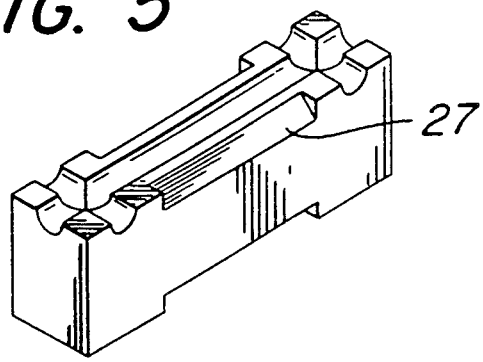
FIG. 5 is a top three-dimensional view of a tying block with tapered longitudinal sides.

The invention pertains to the manufacture, lifting, transportation and/or utilization of prefabricated wall units having generally vertical passages therein.

In one embodiment, the invention provides a novel prefabricated structure and method for constructing, lifting and/or transporting the same, wherein the structure comprises a wall unit comprising a plurality of horizontal courses of construction material stacked one atop another and arranged to define at least one generally vertical passage therein which opens through the unit's bottom end. The novel structure further comprises lifting means positioned on the wall unit's upper end. The lifting means enables the prefabricated wall unit to be lifted and/or transported to any desired location. Moreover, generally vertically-oriented banding means contacts and passes under at least a portion of the unit's bottom end for securing the lifting means to the wall. The inventive structure also comprises spacer means fitted within the opening defined in the unit's bottom end.

The wall unit of the novel structure generally comprises first and second vertical side wall portions. Each side wall portion comprises a plurality of horizontal courses of construction material. The first side wall portion is spaced apart from the second side wall portion. Moreover, the wall unit also comprises first and second vertical end wall portions. Each end wall portion comprises a plurality of horizontal courses of construction material. The first end wall portion is spaced apart from the second end wall portion, and each end wall portion is in contact with and generally perpendicular to each of the side wall portions to define therebetween a passage which opens through the sides, bottom end and/or top end of the unit. In one embodiment of the invention, the passage defined within the wall unit passes at least through the unit's bottom end.

Referring now to FIG. 1, one embodiment of a novel prefabricated structure 10 is illustrated. The structure 10 comprises a wall unit 12 having a plurality of horizontal courses of individual blocks of construction material stacked one atop another and arranged to define at least one generally vertical passage (not shown) therein. The at least one generally vertical passage defined within wall unit 12 passes through at least the unit's bottom end 13. The height of wall unit 12 is determined by the height and number of the individual horizontal courses of construction material.

There is no limit as to the overall height of the wall unit. However, due to height clearance limitations at the prefabrication site, the wall unit is generally less than about twenty feet tall. Preferably, the wall unit is less than about fifteen feet tall, and more preferably, less than about ten feet tall.

The structure 10 further comprises lifting means 14 positioned on the upper end 15 of wall unit 12. The lifting means can be any suitable device and/or apparatus which can be used for lifting prefabricated wall unit 12. The specific type and/or construction of the lifting means will depend, in part, on the height and weight specifications of wall unit 12, the method of banding, and the type of banding means employed. Examples of suitable lifting means include, but are not limited to, a plate constructed of any suitable material (e.g., metal, metal alloys, polymeric compositions and/or wood), a pallet constructed of any suitable material (e.g., metal, metal alloys, polymeric compositions and/or wood), a metal I-beam, and the like, and/or any combinations thereof.

Lifting means 14 further includes an attaching means by which the lifting means may be attached to a lifting device (e.g., a crane). In FIG. 1, the attaching means comprises eye loops 21.

When practicing the invention, the lifting means can have any suitable length. Generally, the length of the lifting means is such that it does not obstruct the lifting and/or positioning process of the prefabricated structure. Preferably, the length of the lifting means is such that it does not extend beyond the vertical ends 17 of the upper end 15 of unit 12. Even more preferably, the length of lifting means 14 is such that its vertical ends 19 are generally flush or slightly smaller than the vertical ends 17 of the upper end 15 of unit 12.

The novel structure of the present invention further comprises generally vertically-oriented banding means 16 for securing wall unit 12 to lifting means 14. Banding means 16 is fitted around the periphery of wall unit 12 and is passed around the sides of wall unit 12, under and in contact with at least a portion of the bottom horizontal course 20 of wall unit 12, and over at least a portion of lifting means 14.

Preferably, banding means 16 is tightened such that lifting means 14 remains substantially adjacent the upper end of wall unit 12 during the lifting process of structure 10. Depending upon the weight of wall unit 12, a minimal gap between the upper end of wall unit 12 and lifting means 14 can be expected.

Banding means 16 should have sufficient strength such that it will support wall unit 12 during lifting. Furthermore, banding means 16 also should not significantly stretch during lifting.

Preferably, banding means 16 comprises a plurality of generally vertical bands 31. Bands 31 can be comprised of any suitable high tensile strength material which will not break and/or significantly stretch during lifting.

The design, configuration, composition and strength requirements of the banding means will depend, in part, on the weight and/or design of the prefabricated wall unit. Examples of suitable materials which can be used for the banding means include, but are not limited to, nylon or synthetic fiber strapping, twine, rope, wire, metal cable, steel bands, and the like, and/or any combination thereof.

Banding means 16 passes under at least a portion of the bottom horizontal course of construction material 20 of wall unit 12. The bottom course 20 of the wall unit must comprise rigid construction material. The rigidity of the construction material can result from any suitable technique and/or composition. For example, rigidity may result from firing, chemically bonding, curing, drying and/or otherwise treating. It is essential that the rigidity of the bottom course 20 is such that it can withstand the inward pressure exerted thereon by banding means 16 during lifting.

Generally, bottom course 20 has notches and/or grooves 22 in its bottom end so that banding means 16 can pass thereunder. However, it is also within the scope of this invention for the lowest course of construction material 20 to have generally horizontal openings therethrough (not shown) through which banding means 16 can pass.

Structure 10 further comprises spacer means 23 (not shown in FIG. 1) fitted within an opening 24 (also not shown in FIG. 1) defined in the bottom end 13 of wall unit 12. FIG. 2 which is a cross-sectioned elevation view taken through line 2—2 of FIG. 1, illustrates the relative position of spacer means 23 within the opening 24 defined in the bottom end 13 of wall unit 12. Spacer means 23 comprises at least two generally vertical sides 26 in contact with at least two opposing inside wall surfaces 32 defining opening 24 through wall unit 12. Spacer means 23 can have any configuration as long as it is in contact with at least two opposing inside wall surfaces defining opening 24. Preferably, spacer means 23 comprises at least two surfaces which have the same configuration as the inside wall surfaces 32 defining opening 24 through the bottom end 13 of wall unit 12.

Spacer means 23 is positioned in opening 24 to counteract the inward pressure exerted by banding means 16 during lifting. Sides 26 of spacer means 23 exert an outwardly-directed force against the inside surfaces 32 of opening 24 so that the side walls of wall unit 12 will not collapse inwardly into the passage within the wall unit during lifting.

Although it is necessary that spacer means 23 be fitted within opening 24, it is not necessary for its bottom end 25 to be flush with the wall unit's bottom end 13. However, it is critical that the sides 26 of spacer means 23 contact enough of the inside surfaces 32 such that, during the lifting process, the wall unit's lowest course 20 does not collapse into opening 24.

Spacer means can have any suitable configuration. Examples of suitable configurations include, but are not limited to, polyhedrally-shaped, tetrahedrally-shaped, elliptically-shaped, circularly-shaped, and the like. In a preferred embodiment, spacer means 23 has substantially the same configuration as opening 24.

Spacer means 23 is also designed such that banding means 16 can pass under at least a portion of its side walls 26. Any suitable technique can be employed to achieve this design. One such suitable example includes securing an elevation means to the bottom end 25 of spacer means 23. The elevation means can comprise any suitable device which will elevate spacer means 23 such that banding means 16 can pass thereunder. Examples of suitable elevation means include, but are not limited to, spacer screws 28, spacer nails (not shown), spacer boards (not shown), and the like, and/or any combination thereof.

It is also within the scope of this invention to have notches, grooves and/or horizontal openings in the spacer's sides 26 such that banding means 16 can pass thereunder and/or therethrough.

Referring now to FIG. 4, one specific embodiment of a suitable spacer means is illustrated. In FIG. 4, spacer means 23 comprises two parallel sides 26. Sides 26 are attached to each other by supporting means 30. Supporting means 30 can be attached to sides 26 using any suitable technique. Examples of such suitable techniques include, but are not limited to, screwing, nailing, gluing, and the like, and/or any combination thereof.

Spacer means 23 can be constructed of any suitable material which can withstand the inward pressure exerted by banding means 16 during lifting. Examples of such suitable materials include, but are not limited to, wood, metal, metal alloys, polymeric compositions, and the like, and/or any combinations thereof.

Optionally, structure 10 can further comprise generally horizontal banding means 18. If employed, banding means 18 is generally wrapped around the lowest course of construction material of wall unit 12. Since horizontal banding means 18 generally does not pass over at least a portion of lifting means 14, banding means 18 is not necessary to support the weight of wall unit 12 during lifting. Therefore, banding means 18 need not have the same tensile strength as banding means 16.

Although it is necessary to have a spacer means fitted within opening 24 during lifting, it is not always necessary to have the spacer means remain within the opening during the normal operation of the wall unit. For example, if the wall unit is employed as an integral part of an oven combustion chamber, the spacer is generally not necessary for the oven's normal operation. As such, the spacer means can optionally be removed after the prefabricated unit is positioned at its final destination.

Any suitable technique can be employed to remove the spacer means after the wall has been lifted and transported to its final destination. One method of removing the spacer means is by physically pulling it out after the wall unit is installed. However, this may be difficult, since the passages within the wall unit often have tying means which pass through the passages.

If the wall unit is employed as an integral part of a furnace combustion chamber, another method of removing the spacer means comprises melting and/or burning the spacer means during initial firing of the combustion chamber. In order to remove the spacer using this technique, however, the spacer means should have vertical passages opening therethrough for flames and/or combustion vapors and/or heated fluids to pass. Furthermore, it is necessary for the spacer means to be constructed of a material which will melt and/or burn during this initial combustion process. It should be noted that, if the spacer means is only to be melted (as opposed to burned), considerations should be made as to whether the melted byproduct will obstruct the passage within the wall unit. As such, under many circumstances, it is preferred to burn the spacer means as opposed to melting it.

In those instances where the wall unit is employed as an integral part of a carbon baking furnace, for example, the normal operating temperatures will generally be at least about 1000° F. Under these conditions, the spacer means can be constructed of any material which will melt and/or burn at or below this temperature. Examples of such materials include, but are not limited to, certain polymeric compositions, wood and/or wood by-products, and the like, and/or mixtures thereof. Preferably, if the spacer means is to be removed by being burned (as opposed to being melted), it is constructed out of wood and/or wood by-products.

In another embodiment, the invention provides a method for sectionally prefabricating a wall, wherein each individual section comprises a wall unit having a plurality of horizontal courses of construction material. These courses are stacked one atop another and arranged to define at least one generally vertical passage within each individual section.

The bottom course of each section should comprise rigid constructional material. The rigidity of the material must be such that it will withstand the inward pressure exerted thereon by the banding means during lifting.

When practicing this embodiment of the invention, a first section of the wall is prefabricated by constructing a wall unit having a plurality of horizontal courses of construction material stacked one atop another and arranged to define at least one generally vertical passage therein. This passage opens through at least the first section's upper end. A lifting means is then placed on the first section's upper end and secured thereto by generally vertically-oriented banding means.

A second section of the wall is also prefabricated by constructing a wall unit having a plurality of horizontal courses of construction material stacked one atop another and arranged to define at least one generally vertical passage therein. This passage opens at least through the second section's bottom end.

The second section comprises spacer means fitted within the passage defined therein. This spacer means is in contact with at least two parallel inside wall surfaces of the lowest course of construction material which defines the opening through the second section's bottom end. The spacer means is positioned within the opening passing through the second section's bottom end such that the second section does not collapse during lifting.

After the second section is completed, lifting means is positioned on its upper end and secured thereto by generally vertically-oriented banding means. The banding means is fitted around the periphery of the second section and under and in contact with at least a portion of its bottom end.

The completed prefabricated first and second sections of the wall are then lifted by their respective lifting means and transported to the installation site. Once at the installation site, the first section is positioned in place by using its lifting means. Thereafter, the banding and lifting means are separated therefrom.

The second section is then lifted, by using its lifting means. The second section's bottom end is fitted on the first section's upper end, such that at least a portion of the opening passing through the first section's upper end is aligned with at least a portion of the opening passing through the second section's bottom end. Thereafter, the banding and lifting means are separated therefrom.

In a preferred embodiment, the opening passing through the upper end of the first section has the same configuration as the opening passing through the bottom end of the second section. Even more preferably, the openings through the top end of the first section and the bottom end of the second section are positioned such that they are substantially aligned when the second section is fitted onto the first section.

When practicing this latter embodiment, the first section can comprise a wall unit wherein the passage defined therein either opens through, or does not open through, its bottom end. If the passage within the first section does open through its bottom end, the first section must further comprise the aforementioned spacer means positioned within the opening passing through its bottom end in the same manner as the spacer means fitted within the opening of the second section. If, on the other hand, the passage within the first section does not open through its bottom end, any known conventional lifting technique can be employed to lift and/or transport this section.

Similarly, the second section can comprise a wall unit wherein the passage defined therein either opens through, or does not open through, the section's upper end.

It should be noted that the process for the sectionalized prefabrication of walls, constructed in accordance with this invention, can comprise more than two sections. For example, if the passage defined within the aforementioned second section, passes through its upper and lower ends, a third section can be prefabricated in accordance with the same procedure for prefabricating the second section. This third section can, thereafter, be lifted and fitted onto the upper end of the second section such that at least a portion of the opening passing through the second section's upper end is aligned with at least a portion of the opening passing through the third section's bottom end. This prefabricated sectionalizing process can continue until the wall reaches any desired height.

By employing the novel features of this invention, a wall having passages therethrough can be prefabricated at a prefabrication site, lifted and transported to an installation site, even though the overall height of the wall exceeds about ten feet.

When practicing the embodiments of the invention, the individual horizontal courses of construction material are generally comprised of a plurality of individual blocks set end-to-end. The arrangement of the individual blocks of construction material depends, in part, upon the specific design necessitated by the final use of the wall unit. For example, the blocks can be arranged to define a plurality of vertical passages and/or horizontal passages within the prefabricated wall unit. Moreover, in addition to the passages opening through either the units' top and/or bottom ends, the walls can also be designed such that the passages open through the sides of the wall.

The composition of the individual blocks of construction material depends, in part, on the specific end use of the completed structure and the desired characteristics of the blocks. The individual blocks of construction material can be made from any suitable material. Examples of materials from which the individual blocks can be constructed include, but are not limited to, refractory materials (e.g., pyrophyllite-andalusite, fire clay, bauxite, etc.), clay, silica, concrete, terra cotta, polymeric materials, brick, and the like, and/or any combination thereof.

U.S. Pat. No. 4,649,687, which is incorporated herein by reference, discloses compositions and configurations of refractory blocks which are especially useful when practicing the present invention.

The design and composition of refractory blocks disclosed in U.S. Pat. No. 4,649,687 can be employed in the construction of wall units without the use of any bonding material. This, however, is not necessary in order to practice the present invention. In other words, while the individual blocks and/or horizontal courses of construction material can be fitted one atop another, the implementation of a bonding material is still within the scope of the invention.

If bonding material is employed during the prefabrication of walls in accordance with the present invention, the bonding material can be placed between the individual blocks and/or horizontal courses of construction material. Any suitable bonding material can be used which will bond together adjacent blocks and/or course of construction material. Examples of suitable bonding material include, but are not limited to, mortar, cement, epoxy, other forms of adhesives, and the like, and/or any combination thereof. The specific bonding material, if employed, will depend, in part, on the composition of the construction material.

If refractory blocks are employed in the construction of prefabricated walls in accordance with this invention, the blocks above the lowest horizontal course need not be fired prior to or during the prefabrication process. For example, non-fired blocks can be used. Under these circumstances, the blocks comprising the wall unit are preferably fired during the normal operation of the unit after it has been installed. This can be accomplished where the wall unit is to be ultimately used as an integral part to a heating and/or combustion device.

In addition to the above, it is also within the scope of the invention to construct a prefabricated wall unit wherein the entire wall is constructed from fired and/or otherwise rigid constructional material and/or blocks. Furthermore, the novel structure of the invention can be constructed of any combination of non-fired, partially fired, fired, and/or otherwise rigid constructional material and/or blocks.

It is also within the scope of the invention to employ constructional material which is only partially fired.

The individual horizontal courses of construction material can be designed to have any suitable configuration. For example, the individual horizontal courses can be constructed from a plurality of generally rectangularly-shaped blocks set end-to-end. These generally rectangularly-shaped blocks can also have a tongue-and-groove configuration. Preferably the plurality of horizontal courses of construction material comprising the prefabricated wall unit are themselves composed of a plurality of individual blocks having a tongue-and-groove configuration (see, FIGS. 1–3 and 5–12).

FIGS. 1–3 and 5–12 illustrate examples of individual blocks having a tongue-and-groove configuration. These blocks can be non-fired, partially fired, fired and/or otherwise rigid. With the specific tongue-and-groove design of the blocks illustrated in FIGS. 1–3 and 5–12, wall unit 12 can be constructed without the use of any bonding compositions (e.g., mortar, adhesive material, etc.).

Figure 7:
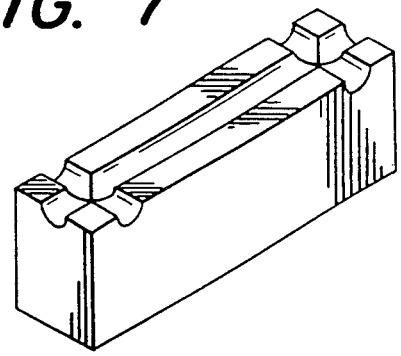
FIG. 7 is a top three-dimensional view of a tying block without tapered sides.
Figure 8:
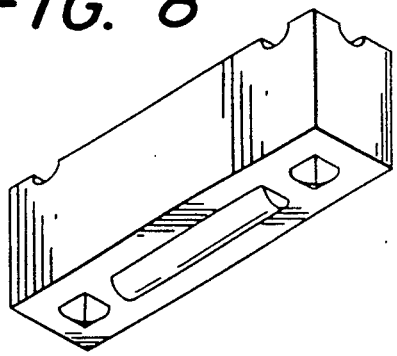
FIG. 8 is a bottom three-dimensional view of a tying block without tapered sides.
Figure 9:
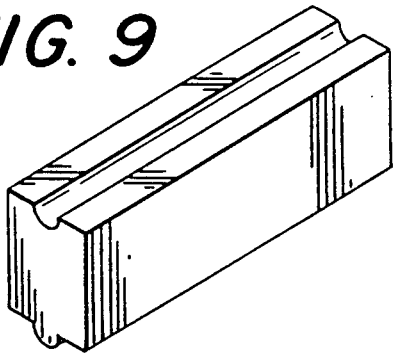
FIG. 9 is a top three-dimensional view of a block having a groove cut in its tongue.
Figure 10:
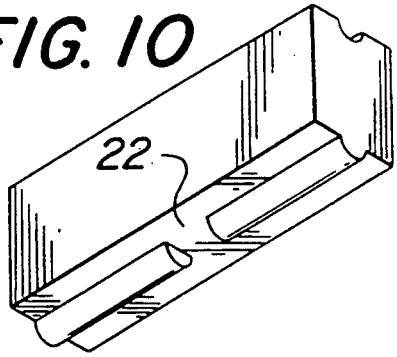
FIG. 10 is a bottom three-dimensional view of a block having a groove cut in its tongue.
Figure 11:
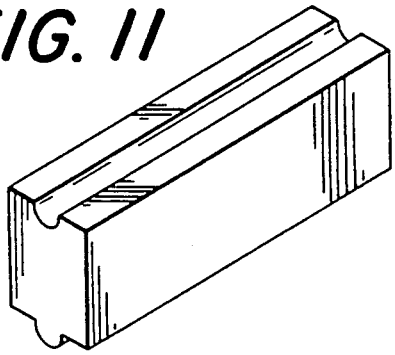
FIG. 11 is a top three-dimensional view of a block having a tongue-and-groove configuration.
Figure 12:
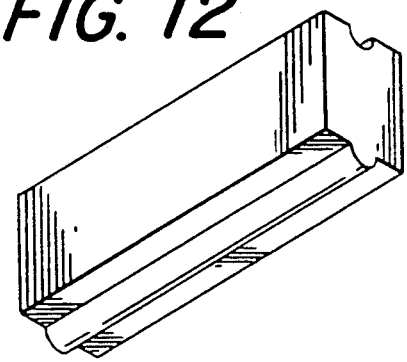
FIG. 12 is a bottom three-dimensional view of a block having a tongue-and-groove configuration.

In the specific design of wall unit 12, tie blocks (e.g., blocks illustrated in FIGS. 5–8) are employed to interconnect the two vertical side wall portions of wall unit 12. The tie block illustrated in FIGS. 7 and 8 is generally used in the wall unit to define baffle means which directs the flow of vapors and/or fluids through the passage defined in wall unit 12.

Figure 6:
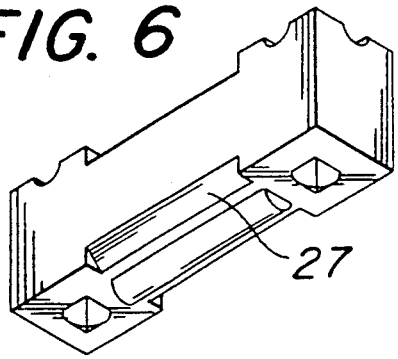
FIG. 6 is a bottom three-dimensional view of a tying block with longitudinal sides.

On the other hand, the tie block illustrated in FIGS. 5 and 6 is generally positioned within the path of the flowing vapors and/or fluids. Since this tie block will be in the path of flowing fluids and/or vapors, it is designed with tapered sides 27 along its longitudinal surfaces. Tapered sides 27 decrease the amount of resistance caused by the block's presence.

It is evident from the foregoing that various modifications, which will be apparent to those skilled in the art, can be made to embodiments of this invention without departing from the spirit and scope thereof. Having thus described the invention, it is claimed as follows.

We claim:

1. A method of constructing and lifting a prefabricated wall unit, said wall unit comprising a plurality of horizontal courses of construction material stacked one atop another and arranged to define at least one generally vertical passage therein which opens through the bottom end of said unit, said method comprising:

(a) constructing said prefabricated unit, said prefabricated unit further comprising spacer means, fitted within said passage for preventing said unit from collapsing when being lifted, said spacer means being in contact with at least two parallel inside surfaces of the lowest course of said construction material;

(b) placing lifting means on the upper end of said unit for lifting said unit;

(c) securing said lifting means to said unit with generally vertically-oriented banding means, said banding means being in contact with and passing under at least a portion of the bottom end of said unit; and (d) lifting said unit by exerting an upward pressure on said lifting means such that said banding means exerts an inward pressure on said spacer means.

2. A method as recited in claim 1 wherein said spacer means comprises first and second vertical side wall portions spaced apart from one another and dimensioned such that the outer surface of each of said spacer means side wall portions is in contact with the inner surface of each of said unit side wall portions defining said opening through said unit bottom end.

3. A method as recited in claim 2 wherein said spacer means further comprises at least one generally vertical opening passing therethrough.

4. A method as recited in claim 1 wherein said plurality of horizontal course of construction material each comprise a plurality of individual blocks of construction material.

5. A method as in claim 4 wherein said individual blocks of construction material comprise materials selected from the group consisting of refractory materials, pyrophyllite-andalusite, fire clay, bauxite, clay, silica, concrete, terra cotta, polymeric materials, brick, and the like, and/or any combination thereof.

6. A method as recited in claim 5 wherein at least a portion of said individual blocks of construction material comprise pyrophyllite-andalusite.

7. A method as recited in claim 5 wherein at least a portion of said individual blocks comprise refractory materials.

8. A method as recited in claim 7 wherein said refractory materials are at least partially fired.

9. A method as recited in claim 7 wherein at least a portion of said refractory materials are non-fired.

10. A method as recited in claim 9 wherein said non-fired refractory materials are fired after said prefabricated wall unit is installed.

11. A method as recited in claim 7 wherein at least a portion of said refractory materials are fired.

12. A method as recited in claim 1 wherein the lowest course of construction material comprises a construction material which has a rigidity sufficient to withstand the inward pressure exerted by said banding means during step (d).

13. A method of constructing and lifting a prefabricated wall unit, wherein said unit comprises:

first and second vertical side wall portions, each comprising a plurality of horizontal courses of construction material stacked one atop another, said first side wall portion being spaced apart from said second side wall portion, and first and second vertical end wall portions, each comprising a plurality of horizontal courses of construction material stacked one atop another, said first end wall portion being spaced apart from said second end wall portion, and each of said end wall portions being in contact with and generally perpendicular to each of said side wall portions to defined therebetween a passage which opens through the bottom end of said unit, said method comprising:

(a) constructing said prefabricated unit, wherein said prefabricated unit further comprises spacer means, fitted within said passage, for preventing said unit from collapsing when being lifted, said spacer means being in contact with at least two parallel inside surfaces of the lowest course of construction material;

(b) placing lifting means on the upper end of said unit for lifting said unit;

(c) securing said lifting means to said unit with generally vertically-oriented banding means, wherein said banding means passes over said unit side wall portions, under at least a portion of said spacer means, over at least a portion of said lifting means and under at least a portion of said lowest course of construction material, said lowest course of construction material having sufficient rigidity to withstand the inward pressure exerted thereon by said banding means when lifting said unit from said lifting means; and (d) lifting said unit by exerting an upward pressure on said lifting means such that said banding means exerts an inward pressure on said spacer means.

14. A method as recited in claim 13 wherein said spacer means comprises first and second vertical side wall portions, spaced apart from one another and dimensioned such that the outer surface of each of said spacer means side wall portions is in contact with the inner surface of each of said unit side wall portions defining said opening through said unit bottom end.

15. A method as recited in claim 14 wherein said spacer means further comprises at least one generally vertical passage opening therethrough.

16. A method as recited in claim 13 wherein after step (d) said prefabricated unit is transported.

17. A method as recited in claim 16 wherein after step (d) said prefabricated unit is transported to a storage site.

18. A method as recited in claim 16 wherein after step (d) said prefabricated unit is transported to an installation site and installed.

19. A method as recited in claim 18 wherein, after said prefabricated unit is transported to said installation site and installed, said lifting means and said banding means are removed from said unit.

20. A method as recited in claim 19 wherein, after said prefabricated unit is transported to said installation site and installed, and after said lifting means and said banding means are removed from said unit, said spacer means is removed from within the passage defined within said unit.

21. A method as recited in claim 20 wherein said spacer means is removed by being burned.

22. A method as recited in claim 13 wherein said plurality of horizontal course of construction material each comprise a plurality of individual blocks of construction material.

23. A method as in claim 22 wherein said individual blocks of construction material comprise materials selected from the group consisting of refractory materials, pyrophyllite-andalusite, fire clay, bauxite, clay, silica, concrete, terra cotta, polymeric materials, brick, and the like, and/or any combination thereof.

24. A method as recited in claim 23 wherein at least a portion of said individual blocks of construction material comprise pyrophyllite-andalusite.

25. A method as recited in claim 23 wherein at least a portion of said individual blocks of construction material comprise refractory materials.

26. A method as recited in claim 25 wherein at least a portion of said refractory materials are at least partially fired.

27. A method as recited in claim 25 wherein at least a portion of said refractory materials are non-fired.

28. A method as recited in claim 27 wherein said refractory materials are fired after said prefabricated wall unit is installed.

29. A method as recited in claim 25 wherein at least a portion of said refractory materials are fired.

30. A liftable, transportable prefabricated structure comprising:

(a) a wall unit comprising a plurality of horizontal courses of construction material stacked one atop of another and arranged to define at least one generally vertical passage within said unit, said passage opening through said unit bottom end;

(b) lifting means, positioned on said unit upper most horizontal course of said construction material, for lifting said unit;

(c) banding means for securing said lifting means to said unit, said banding means being generally vertically-oriented and being in contact with and passing under at least a portion of said unit lowest horizontal course of construction material; and (d) spacer means fitted within said unit passage, said spacer means being in contact with at least two parallel inside surfaces of said unit lowest horizontal course of construction material defining said passage which opens through said unit bottom end, and being positioned within said unit passage and being dimensioned such that said unit can be lifted without collapsing.

31. A prefabricated structure as recited in claim 30 wherein said plurality of horizontal courses of construction material each comprise a plurality of individual blocks.

32. A prefabricated structure as recited in claim 31 wherein said individual blocks comprise materials selected from the group consisting of refractory materials, pyrophyllite-andalusite, fire clay, bauxite, clay, silica, concrete, terra cotta, polymeric materials, brick, and the like, and/or any combination thereof.

33. A prefabricated structure as recited in claim 32 wherein at least a portion of said individual blocks comprise pyrophyllite-andalusite.

34. A prefabricated structure as recited in claim 32 wherein at least a portion of said individual blocks comprise refractory materials.

35. A prefabricated structure as recited in claim 34 wherein at least a portion of said refractory materials are at least partially non-fired.

36. A prefabricated structure as recited in claim 34 wherein at least a portion of said refractory materials are non-fired.

37. A prefabricated structure as recited in claim 34 wherein at least a portion of said refractory materials are fired.

38. A prefabricated structure as recited in claim 30 wherein said wall unit further comprises individual tie blocks passing through said passage defined within said wall unit.

39. A prefabricated structure as recited in claim 38 wherein at least a portion of said tie blocks have tapered longitudinal sides.

40. A prefabricated structure as recited in claim 30 wherein said horizontal courses of construction material have a tongue-and-groove configuration.

41. A prefabricated structure as recited in claim 30 wherein the lowest course of construction material comprises a material which has a rigidity sufficient to withstand the inward pressure exerted by said banding means when said wall unit is lifted from said lifting means.

* * * * *